United States Patent [19]

Sueyoshi et al.

[11] Patent Number: 4,944,696

[45] Date of Patent: Jul. 31, 1990

[54] ELECTRICAL CONNECTOR APPARATUS

[75] Inventors: Tadahiro Sueyoshi; Takayuki Yamamoto; Masanori Tsuji, all of Shizuoka, Japan

[73] Assignee: Yazaki Corporation, Tokyo, Japan

[21] Appl. No.: 437,725

[22] Filed: Nov. 17, 1989

[30] Foreign Application Priority Data

Dec. 19, 1988 [JP] Japan ..... 63-318467

[51] Int. Cl.[5] ..... H01R 00/00

[52] U.S. Cl. ..... 439/595; 439/598

[58] Field of Search ..... 439/595, 597, 598

[56] References Cited

U.S. PATENT DOCUMENTS 3,686,619 8/1972 McCardell, Jr. ..... 339/59
4,557,542 12/1985 Coller et al. ..... 439/595
4,714,437 12/1987 Dyki ..... 439/595
4,820,198 4/1989 Lulko et al. ..... 439/595

*Primary Examiner*—P. Austin Bradley
*Attorney, Agent, or Firm*—Armstrong, Nikaido, Marmelstein, Kubovcik & Murray

[57] ABSTRACT

The electrical connector according to the present invention is capable of doubly latching a terminal inside the terminal accommodation chamber of the insulated housing, with a locking device (locking plate) additionally provided to further secure the double latched state. This arrangement checks for any improperly inserted terminals while reinforcing the hold on the terminal in place. In addition, the reliability of the electrical connection by the connector is further boosted by the device embodying the present invention.

6 Claims, 8 Drawing Sheets

ELECTRICAL CONNECTOR APPARATUS

BACKGROUND OF THE INVENTION

1. Field of the Invention

The present invention relates to an electrical connector for use in the connection between electrical wires or between an electrical wire and electrical apparatus and, in particular, to an electrical connector adapted doubly to prevent inadvertent disengagement of a terminal connected thereto during use.

2. Description of the Prior Art

There have been prior art connectors that comprise a deflectable latching arm having notches inside its terminal accommodation chamber means in an insulated housing, with the notches being engaged with a recess or the shoulder of a terminal being connected.

With such connectors, it was difficult to manufacture a latching arm small enough to fit into the narrow terminal accommodation chamber means. The latching arm of such a restricted construction provided only a limited hold on the terminal within. There was a constant possibility that the tensile force on the electrical wire might damage or destroy the latching arm, inadvertently releasing the terminal during use.

FIGS. 9 and 10 illustrate an improvement over these conventional connectors. This apparatus, disclosed in Japanese Patent Laid-open No. 58-44776, provides double latching of a terminal inside by having a spacer 7 inserted from behind the terminal 2 which is snugly fit in terminal accommodation chamber 1 of an insulated housing M, with a notch 9 of a terminal latching rod 8 engaged with a shoulder 3 of the terminal. In the figures, reference number 4 is a hole (recess) provided on the base of the terminal 2, and 5 is a latching arm having a notch 6 which fits in the hole 4.

The double latching construction of prior art terminals has relied mainly on the spacer 7 which is separate from the insulated housing M, the terminal accommodation chamber 1 incorporating the latching arm 5 alone to provide primary latching force to keep the terminal 2 in place.

The spacer 7 may be inserted even when the terminal 2 is not inserted all the way to its proper position, with the notch 6 disengaged from the hole 4. Thus, a forced insertion of the spacer 7 can damage the terminal 2 or latching arm 5. Furthermore, an improperly inserted spacer can be overlooked for lack of any apparently missing function at the time.

SUMMARY OF THE INVENTION

Accordingly, it is an object of the present invention to provide an electrical connector which has a double latching arrangement between a terminal and the terminal accommodation chamber means in the insulated housing, without the need for spacers or the like to implement the arrangement.

It is another object of the present invention to provide an electrical connector having a locking means that reinforces the doubly latched state attained by the arrangement mentioned above.

The objects of the present invention are attained by providing an electrical connector substantially constructed as follows. First of all, an electrical connector embodying the invention has a terminal accommodation chamber means in an insulated housing equipped with a latching arm extending in front of its opening and having a terminal latching part. The terminal latching part is engaged with a latching part of a terminal when it is inserted in the proper position of the chamber means, whereby preventing inadvertent disengagement of the terminal during use. The electrical connector comprises a deflectable terminal latching plate integrally extending backward from the front of the opening of the terminal accommodation chamber means. The terminal and the latching part matched therewith have notches each. The latching arm is formed by extending integrally forward from the free edge part in back of the terminal latching plate. The terminal latching plate has a latching part which is engaged with the notches of the terminal.

As shown in FIG. 4C, the doubly latched state of the terminal is reinforced by a locking means which is detachably provided between the terminal latching plate and the inner wall of the terminal accommodation chamber means. The locking means is provided to prevent deflection of the terminal latching plate toward the inner wall.

The latching arm whose terminal latching part is engaged with the latching part of the terminal may also be constructed separately from the terminal latching plate whose latching groove is engaged with the notches of the terminal, as set forth in FIG. 6.

BRIEF DESCRIPTION OF THE DRAWINGS

The specific nature of the invention, as well as other objects, usage and advantages thereof will become more apparent from the following description taken in conjunction with the accompanying drawings in which.

DETAILED DESCRIPTION OF THE PREFERRED EMBODIMENTS

Figure 1:
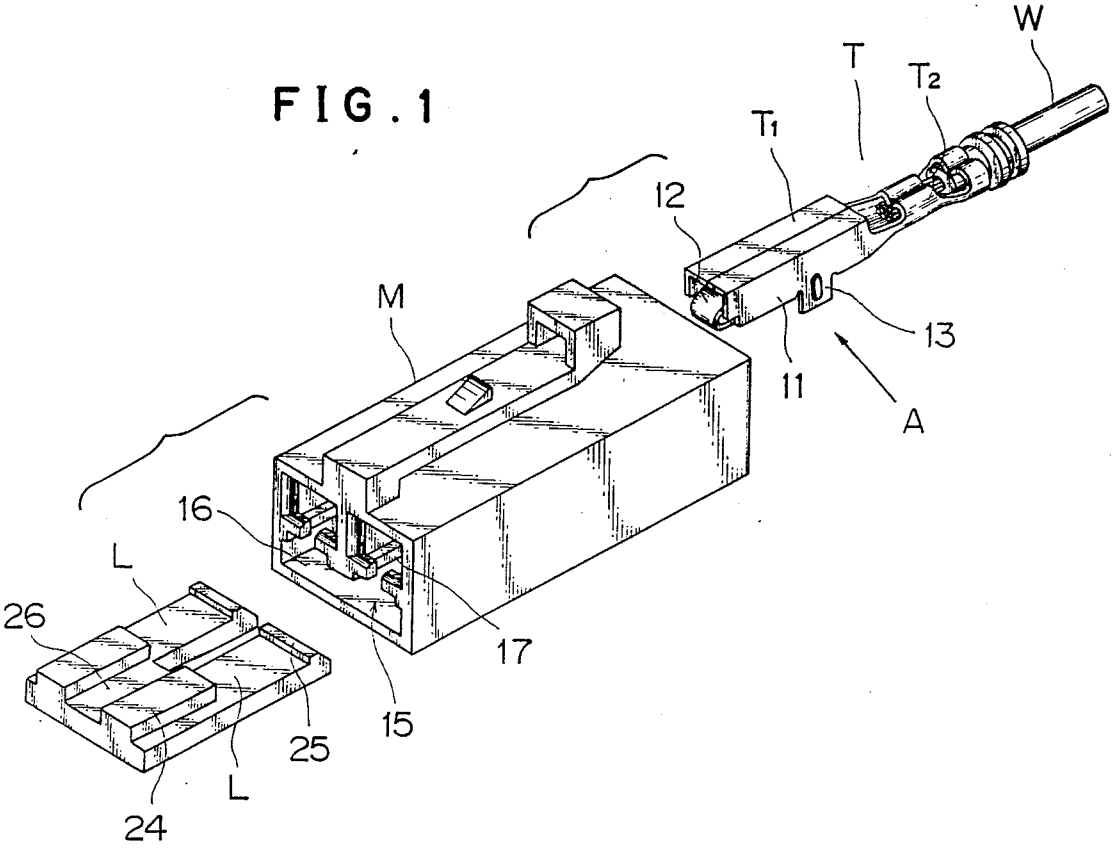
FIG. 1 is an exploded perspective view of an electrical connector embodying the present invention.
Figure 2:
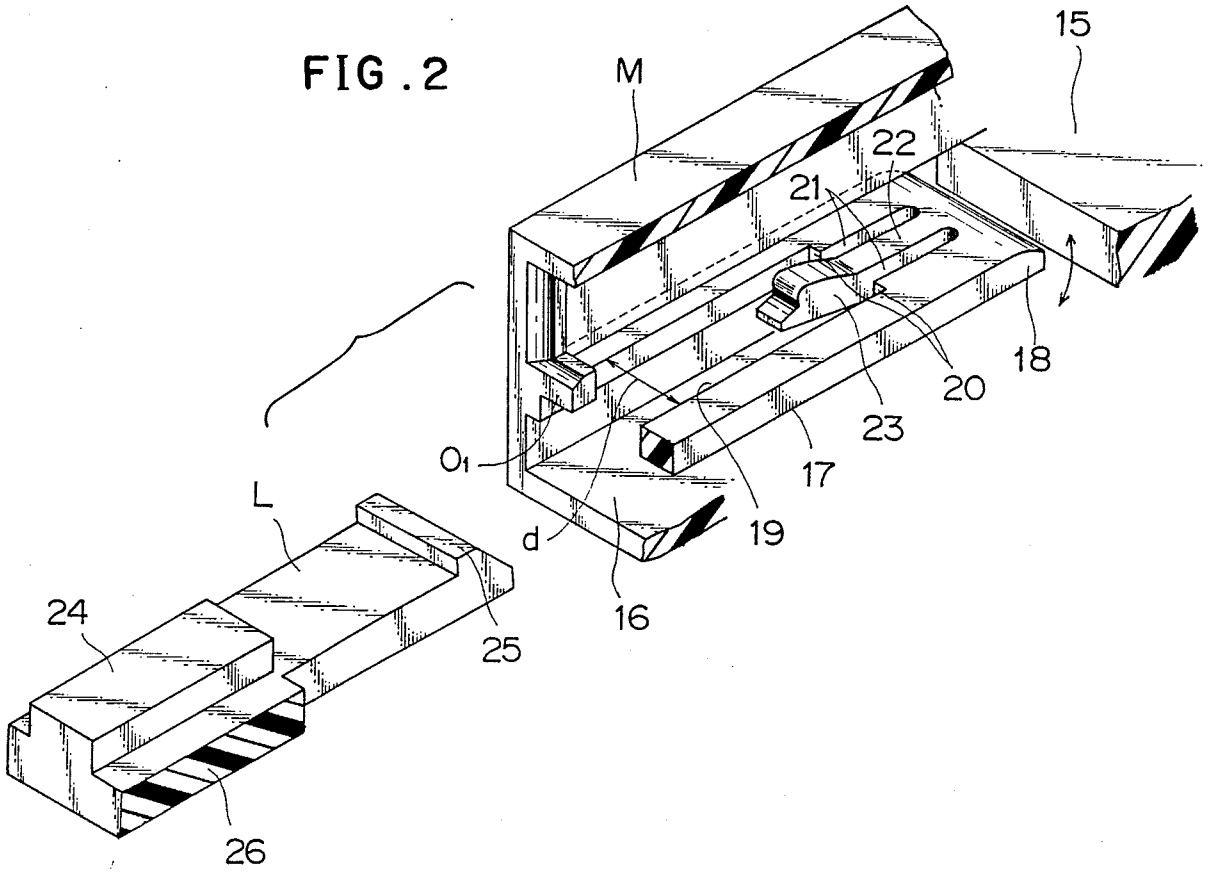
FIG. 2 is an enlarged perspective view of a terminal accommodation chamber and a locking plate of the electrical connector.
Figure 3:
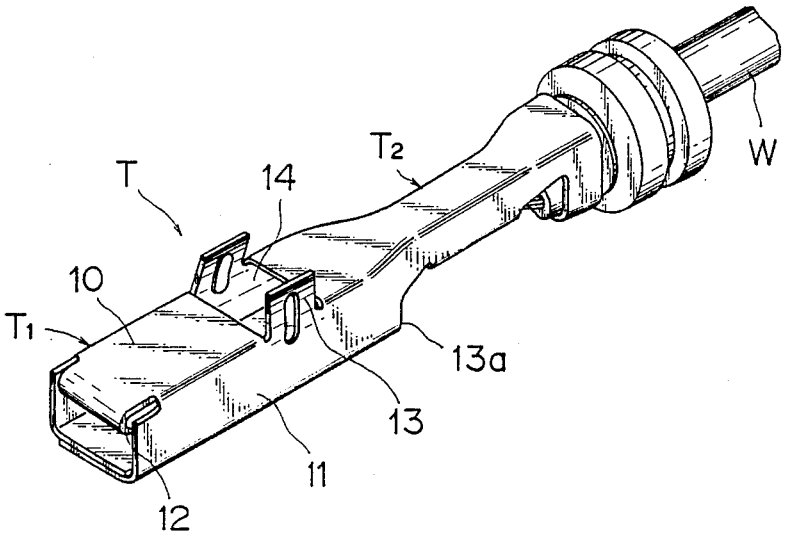
FIG. 3 is a view of the female terminal of FIG. 1 taken in direction A.

FIG. 1 is an exploded perspective view of an electrical connector embodying the present invention; FIG. 2 is an enlarged perspective view of a terminal accommodation chamber and a locking plate of the electrical connector; FIG. 3 is a view of the female terminal of FIG. 1 taken in direction A; and FIGS. 4A through 4D are cross-sectional views of the female terminal as it is applied.

In FIG. 1, reference character M is a male housing, T is a female terminal, and L is a locking plate.

As shown enlarged in FIG. 3, the female terminal T has its base 10 comprised of an electrical contacting part T1 at one end and an electrical wire connecting part T2 at the other. A wire W is connected to the connecting part T2 in crimp style. The electrical contacting part T1 comprises a tab receptacle 11 which receives the mating tab formed of the two side walls of the base 10 being inwardly bent, and an elastic contacting piece 12 formed by being bent from the tip of the base 10 into the tab receptacle 11. At the electrical contacting part T1, a hole (recess) 14 that latches on to the terminal latching part, to be described later, along with downwardly oriented notches 13, is made by cuts.

The male housing M has a plurality of terminal accommodation chambers (two shown) that accommodate the female terminal T.

As shown in FIG. 2, each terminal accommodation chamber 15 has a terminal latching plate 17 disposed a certain distance away from an inner wall 16 of the chamber and integrally extending backward from an opening O1 of the chamber. The terminal latching plate 17 is elastically provided and deflects vertically as indicated by the broken line. This plate 17 is provided with a passage 19 extending from its front end center to a free edge 18 in the rear. At the end of the passage 19, there is provided a latching part 20 designed for engagement with notches 13, along with a flexible latching arm 22 having a projection 23 that acts as a terminal latching part via two slits 21 extending from the rear free edge 18. The latching part 20 and the projection 23 are located so that when the female terminal T is inserted in the proper position of each chamber 15, the latching part and notches are engaged respectively with the notches 13 and hole 14. The passage 19 is wide enough to allow the two opposite notches 13 to enter and protrude downward.

The locking plate L has at its center a guide rail 24 aligned with the passage 19 as well as an upwardly oriented latching pawl 25 at its end. The latching pawl 25 is engaged with the rear free edge 18 of the terminal latching plate 17. In this embodiment, two locking plates L are connected by means of a connecting plate 26, as shown in FIG. 1. However, there may be connected three or more locking plates, the number being as many as the terminal accommodation chamber 15 provides. Alternatively, the locking plates may be constructed separately for discrete use.

Figure 4A:
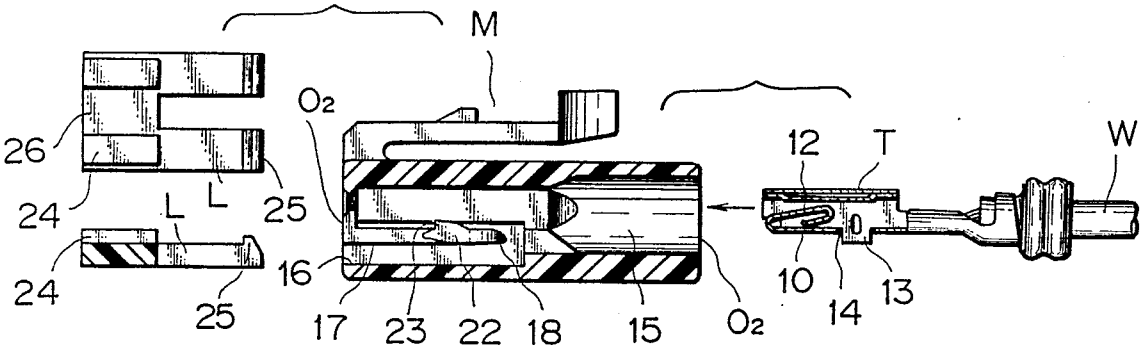
FIGS. 4A through 4D are cross-sectional views of the female terminal as it is applied.

As shown in FIG. 4A, the female terminal T is inserted, with its notches 13 facing downward, through the rear end opening O2 of the terminal accommodation chamber 15.

Figure 4B:
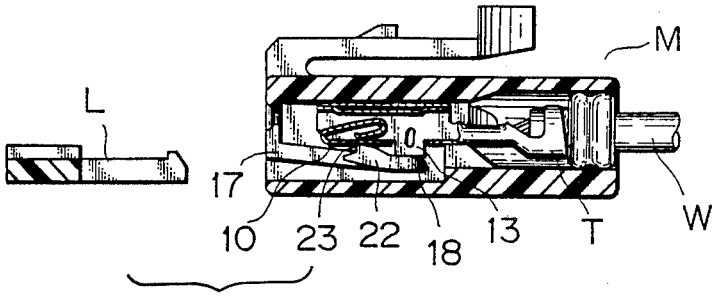

Halfway through the insertion, as depicted in FIG. 4B, the notches 13 come in contact with the upper surface of the rear free edge 18 of the terminal latching plate 17, deflecting the latching plate downward. In accordance with the deflection, the latching arm 22 moves downward, affording its projection 23 only negligible contact with the base 10 of the female terminal T. This minimizes the resistance during the insertion.

Figure 4C:
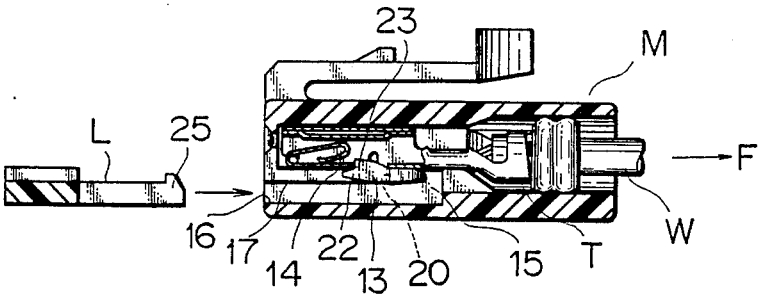

When the female terminal T, being pushed, moves into its proper position inside the chamber, as shown in FIG. 4C, the rear end of the notches 13 reaches the passage 19. This releases the terminal latching plate 17 from the pressure exerted by the notches 13, allowing the plate to rebound elastically.

As a result, the projection 23 of the latching arm 22 is engaged with the front edge of the hole 14 of the female terminal T, and the rear ends of the notches 13 are engaged with the latching part 20 of the terminal latching plate 17. Thus the terminal T is doubly protected from inadvertent disengagement during use.

Figure 4D:
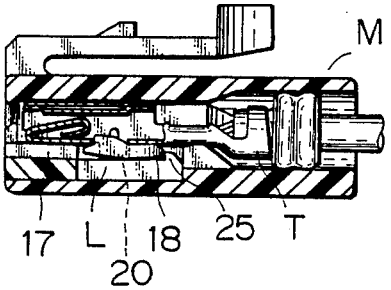

When the locking plate L is inserted through the gap between the inner wall 16 of the terminal accommodation chamber 15 and the terminal latching plate 17 in the state described above, the latching pawl 25 is engaged with the rear free edge of the terminal latching plate 17, as shown in FIG. 4D, and is locked therein.

The arrangement above prevents the terminal latching plate 17 from deflecting toward the inner wall 16. This reinforces the latching force that keeps the female terminal T in place.

As evident in FIG. 4D, the locking plate L cannot be inserted while the female terminal T is being inserted. It follows that any improper insertion of the terminal is known before the connector is fully engaged and ready for use.

In FIG. 4C, a tensile force F applied onto the female terminal T causes the notches 13 engaged with the latching part 20 to exert a force onto the terminal latching plate 17 in the same direction as the axis of the wire W. Thus the tensile force will not disengage the latches 13 from the latching part 20.

As indicated above, the electrical connector according to the present invention utilizes the double latching arrangement between the terminal accommodation chamber means and the terminal, accompanied by the locking plates, to check for any improper insertion of the terminal as well as to reinforce the connection.

OTHER EMBODIMENT

Figure 5:
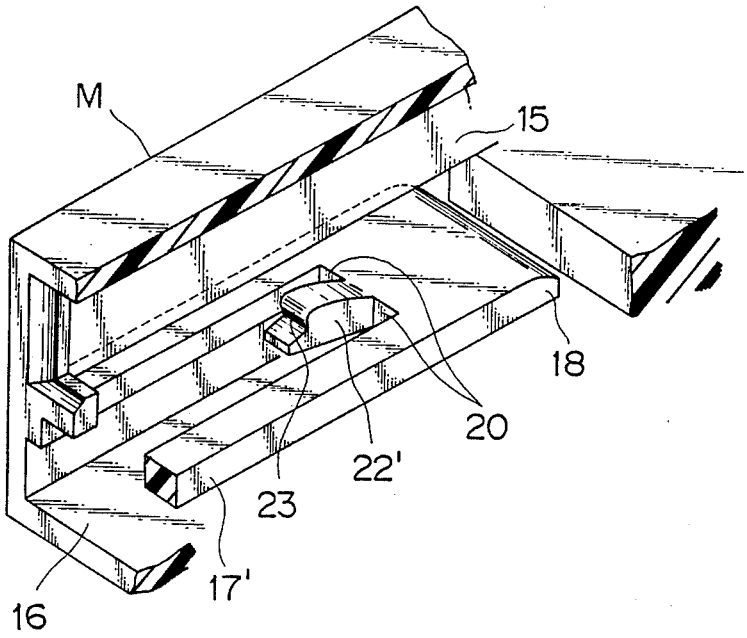
FIGS. 5 and 6 are broken views of major parts constituting a second and third embodiment of the present invention.

In FIG. 5, a terminal latching plate 17' is formed of a latching arm 22' having a projection 23. In this second embodiment, the construction of the terminal latching plate 17' is simpler than that of the terminal latching plate 17 in the above-described embodiment. However, the double latching effect on the terminal remains unchanged.

Figure 6:
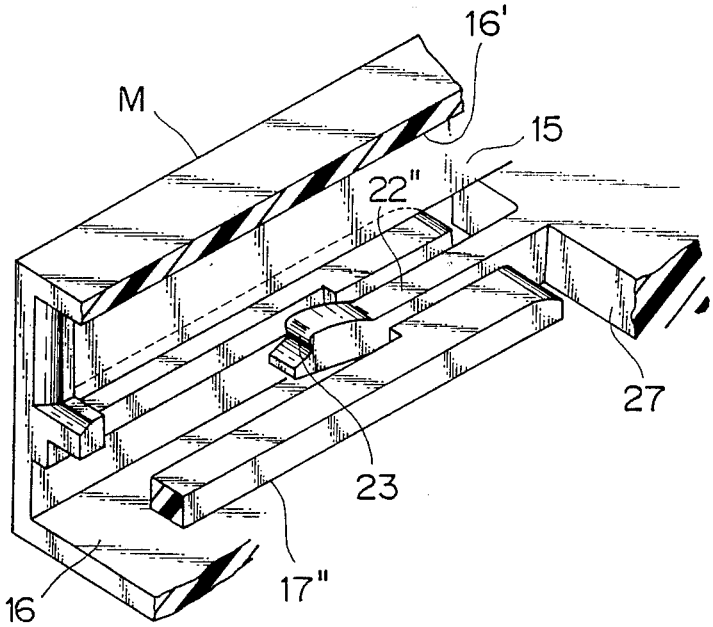

In FIG. 6, a terminal latching plate 17'' is separated from a deflectable latching arm 22'' having a projection 23, the latching arm protruding from a center partition 27 inside the terminal accommodation chamber 15. In this third embodiment, the projection 23 does not follow terminal latching plate 17'' as it is deflected by the notches 13 while the terminal T is being inserted, as can be seen from a comparison with FIG. 4B. Thus the inserting force of the terminal T is increased, and the degree of flexibility of the latching arm 22'' can be adjusted as desired regardless of the thickness of the terminal latching plate 17''. The double latching effect on the terminal remains the same as in the first embodiment.

As evident from FIG. 6, the latching arm 22'' is also allowed to project from a ceiling wall 16' of the terminal accommodation chamber 15, with the projection 23 engaged with a shoulder **13*a* (FIG. 3) in back of the receptacle 11** of the female terminal T.

The latching arms 22, 22' and 22'' in FIGS. 2, 5 and 6 have each a projection 23 that acts as a terminal latching part, the projection being engaged with the hole 14 of the female terminal T. Alternatively, a recess 23' may be provided at the tip of the projection, as shown in connection with the latching arm 22''' in FIG. 7. In this fourth embodiment, as shown in FIG. 8, a lance 14' may be formed by a cut on the base 10 of the female terminal T for engagement with the recess 23''. This causes the latching arm 22'''to keep the terminal T in place.

Figure 7:
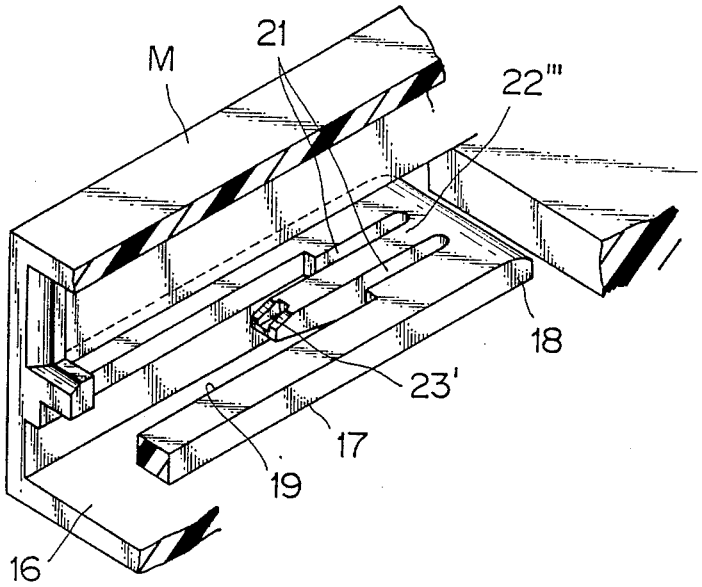
FIG. 7 is a broken perspective view of major parts forming a fourth embodiment of the present invention.
Figure 8:
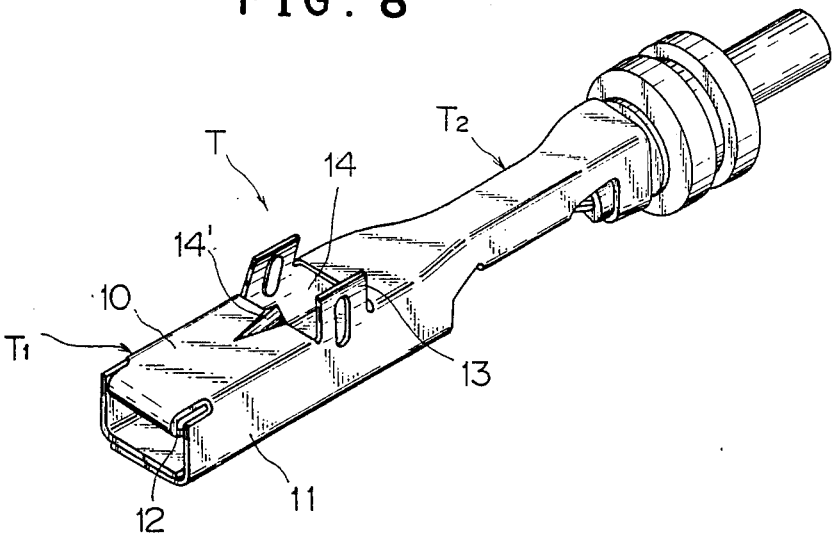
FIG. 8 is a perspective view of a female terminal T in the fourth embodiment.
Figure 9:
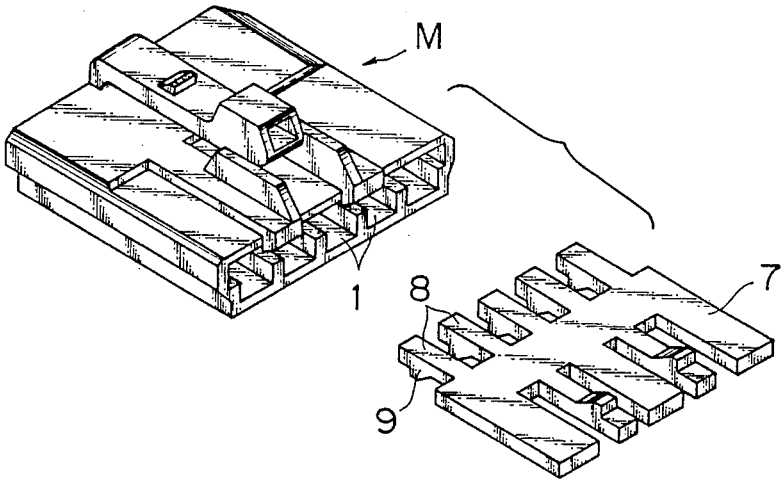
FIG. 9 PRIOR ART
FIG. 9 is an exploded perspective view of a prior art electrical connector.
Figure 10:
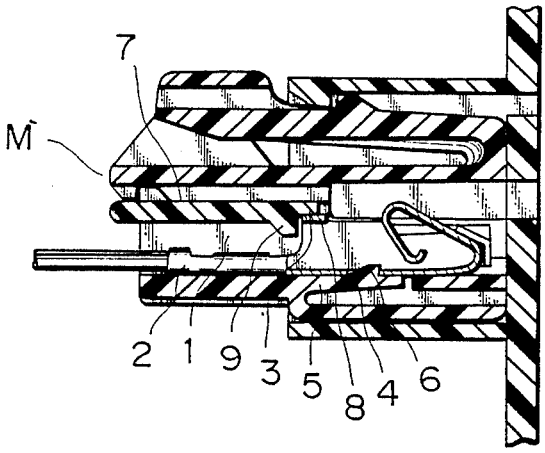
FIG. 10 PRIOR ART
FIG. 10 is a cross-sectional view of the electrical connector of FIG. 9 as it is assembled.

Although the locking plate L is not shown in FIGS. 5 through 7, this part can also be used in the same manner as in the first embodiment.

The foregoing are the preferred embodiments in which the terminal latching plate 17, 17' or 17" is used to doubly latch the female terminal T. It will be readily understood by those skilled in the art that the invention can also be applied to cases involving male terminals.

As described above, the electrical connector according to the present invention is capable of doubly latching a terminal inside the terminal accommodation chamber means of the insulated housing, with a locking means (locking plate) additionally provided to further secure the doubly latched state. This arrangement checks for any improperly inserted terminal while reinforcing the hold on the terminal in place. In addition, the reliability of the electrical connection by the connector is further boosted by the device embodying the present invention.

What is claimed is:

1. An electrical connector apparatus having a terminal accommodation chamber means in an insulated housing equipped with a latching arm means extending in front of an opening and having a terminal latching part, said latching arm means is engaged with a latching part of a terminal when said terminal is inserted in a proper position of said chamber means so as to subsequently prevent inadvertent disengagement of said terminal, characterized in that said electrical connector apparatus includes a deflectable terminal latching plate integrally extending backward from the front of the opening of said terminal accommodation chamber means and being formed with said latching arm means which is extending integrally forward from a free edge part in a back portion of said terminal latching plate, said terminal latching plate also having a latching groove, said terminal having notches apart from said latching part thereof, wherein said notches can be engaged with said latching groove in said proper position.

2. An electrical connector apparatus as claimed in claim 1, wherein said latching arm is constructed so as to be elastically deflectable in a vertical direction with respect to said terminal latching plate.

3. An electrical connector apparatus as claimed in claim 1, wherein said latching arm is formed by a rigid material.

4. An electrical connector apparatus as claimed in claim 1 further comprises a locking means detachably provided between said terminal latching plate and an inner wall of said terminal accommodation chamber means so as to prevent deflection of said terminal latching plate toward said inner wall.

5. An electrical connector apparatus having a terminal accommodation chamber means in an insulated housing equipped with a latching arm means extending in front of an opening and having a terminal latching part, said latching arm means is engaged with a latching part of a terminal when said terminal is inserted in a proper position of said chamber means so as to subsequently prevent inadvertent disengagement of said terminal, characterized in that said electrical connector apparatus includes a deflectable terminal latching plate integrally extending backward from the front of the opening of said terminal accommodation chamber means, said terminal latching plate also having a latching groove, said terminal having notches apart from said latching part thereof, wherein said notches can be engaged with said latching groove in said proper position.

6. An electrical connector apparatus as claimed in claim 5 further comprises a locking means detachably provided between said terminal latching plate and an inner wall of said terminal accommodation chamber means so as to prevent deflection of said terminal latching plate toward said inner wall.

* * * * *